United States Patent [19]

Wiggins et al.

[11] Patent Number: 4,674,689

[45] Date of Patent: Jun. 23, 1987

[54] MILLING MACHINES

[75] Inventors: Robert Wiggins, Sevenoaks; William R. King; Jeffrey G. Barker, both of High Wycombe; Geoffrey A. LeGrys, Wheatley, all of United Kingdom

[73] Assignee: Ranks Hovis McDougall Ltd., Berkshire, England

[21] Appl. No.: 322,214

[22] Filed: Nov. 17, 1981

[30] Foreign Application Priority Data

Nov. 19, 1980 [GB] United Kingdom ..... 8037127

[51] Int. Cl.[4] ..... B02C 7/14

[52] U.S. Cl. ..... 241/6; 241/30; 241/252; 241/253; 241/259; 241/259.1; 241/261.2

[58] Field of Search ..... 241/6–12, 241/30, 296, 298, 252, 253, 259, 259.1, 259.2, 259.3, 261.2, 261.3, 257 R, 258

[56] References Cited

U.S. PATENT DOCUMENTS

| | | | |
|---|---|---|---|
| 2,589,307 | 3/1952 | Symons | 241/252 |
| 3,586,250 | 6/1971 | Shouvlin | 241/252 |
| 3,593,929 | 7/1971 | Hughes | 241/252 X |
| 3,848,814 | 11/1974 | Syrjanen | 241/37 |

FOREIGN PATENT DOCUMENTS

| | | |
|---|---|---|
| 1964382 | 7/1971 | Fed. Rep. of Germany . |
| 2316389 | 10/1974 | Fed. Rep. of Germany . |
| 2448013 | 4/1976 | Fed. Rep. of Germany . |
| 955821 | 1/1950 | France . |
| 351912 | 12/1929 | United Kingdom . |
| 333635 | 8/1930 | United Kingdom . |
| 494930 | 11/1938 | United Kingdom . |
| 739615 | 11/1955 | United Kingdom . |
| 1172895 | 12/1969 | United Kingdom . |
| 1266379 | 3/1972 | United Kingdom . |
| 1473970 | 5/1977 | United Kingdom . |
| 1481258 | 7/1977 | United Kingdom . |
| 1501741 | 2/1978 | United Kingdom . |

*Primary Examiner*—Mark Rosenbaum

[57] ABSTRACT

A milling machine particularly a disc mill for processing cereal seeds and cereal derivatives including a top disc through a central opening in which the material may be fed, and a bottom disc spaced from the top disc, both discs having mutually opposed profiled surfaces and the distance between the discs and the offset of the axes being adjustable to obtain optimum milling of the materials.

5 Claims, 8 Drawing Figures

MILLING MACHINES

INTRODUCTION

This invention relates to disc mills particularly for the processing of cereal seeds such as wheat, barley and maize and cereal derivatives such as semolina or seeds which have been partially broken down. These disc mills may also find application in the processing of oil bearing materials such as sorghum and also soya and rape. Still further, these disc mills may also be useful for the breaking down of glass or other inorganic granules. A disc mill is just one type of mill which has been used for very many years in the milling of cereal seeds for the production of flour. Other types of mills are roller mills, hammer mills, pin mills, centrifugal mills and traditional millstones.

PRIOR ART

British Patent Specification No. 1,481,258 (Schnitzer) is concerned with a corn mill for domestic use and proposes axial adjustment of the two mills so that the degree of fineness of the ground material and the abrasion of the millstones is easily adjustable.

British Patent Specification No. 1,172,895 (Heidenan) is also concerned with a disc mill for the fine grinding of cocoa or the like and deals with a particular problem which arises when the two grinding discs are without grinding grooves. Centrifugal force is an important factor and hence the discs are rotated in the same direction at specified speed ratios. The rotational centres of the discs may coincide or be offset eccentrically. In this latter manner, the centrifugal forces acting on the particles is increased.

British Patent Specification No. 1,266,379 is concerned with a disc refiner for high density pulp, particularly for defiberizing the pulp. The mill discs are disposed with their opposed faces vertical. There is a mechanism whereby one of the shafts which carries a disc is adjustable so as to achieve precise parallelism of the faces of the discs and to adjust the two shafts so that they are non-aligned. This gives an eccentric refining action.

OBJECT OF THE INVENTION

It is the main object of this invention to provide a disc mill which is capable of optimum milling with increased throughput.

STATEMENT OF INVENTION

According to the present invention there is provided a method of breaking down particulate material, which includes feeding the material by gravity through an axial opening in a first member, the underside of first said member having a profiled surface; adjusting the distance between said first profiled surface and an upwardly facing profiled surface of a second member; and adjusting the degree of offset of the two profiled surfaces so that relative rotational movement of the two profiled surfaces effects optimum break-down of the particulate material. The method may also include the first member being a rotating disc and/or the second member being a rotating disc, the processed material being discharged at the periphery of the disc or discs.

The invention also includes a method of milling cereal seeds and their derivatives which includes feeding the material by gravity through an axial opening in a top disc so that the material enters the area between the top disc and a bottom disc, said discs having their mutually opposed surfaces profiled, causing both of said discs to rotate about their axes so that relative movement of the profiled surfaces occurs; and adjusting the distance between the profiled surfaces and the degree of offset of the axes of the discs to effect optimum milling of the material which is discharged at the peripheries of the discs. The invention also includes the method of milling as recited above, in which the discs are caused to rotate in opposite directions. However, the discs may rotate in the same direction.

The invention further includes a mill comprising a first member having an axial opening therein through which particulate material may be fed for milling, a second member positioned beneath said first member, said first and second members having mutually opposed profiled surfaces, means for rotating both of said members so that particulate material between said profiled surfaces is milled; and means for adjusting the distance between said profiled surfaces and the degree of offset thereof to effect optimum milling.

The invention includes a mill as above in which at least one of said members is a disc.

Further, the invention includes a disc mill comprising a top disc having an axial opening therein through which seeds or their derivatives to be milled may be fed by gravity, a bottom disc below said top disc, said top disc and said bottom disc having opposed profiled surfaces to effect milling, means for rotating said top and said bottom discs and means for independently adjusting the speeds of rotation thereof; and means for adjusting the offset of the axes of rotation of the discs to effect optimum milling of the material.

Conveniently the top disc opening is flared outwardly in a downward direction. Also, both discs may be made of metal, traditional millstone or other hard material such as ceramics or carborundum, or traditional millstone on metal.

The aforesaid discs may have grooves in the surfaces thereof tangential to a notional circle with its centre on the axis of the disc, said grooves becoming progressively shallower as they near the periphery of the disc. Said grooves may be arranged in sets, the grooves in each set being parallel and progressively shorter in length.

SPECIFIC DESCRIPTION

In order to illustrate the invention, reference will now be made to the accompanying drawings, in which.

Figure 1:
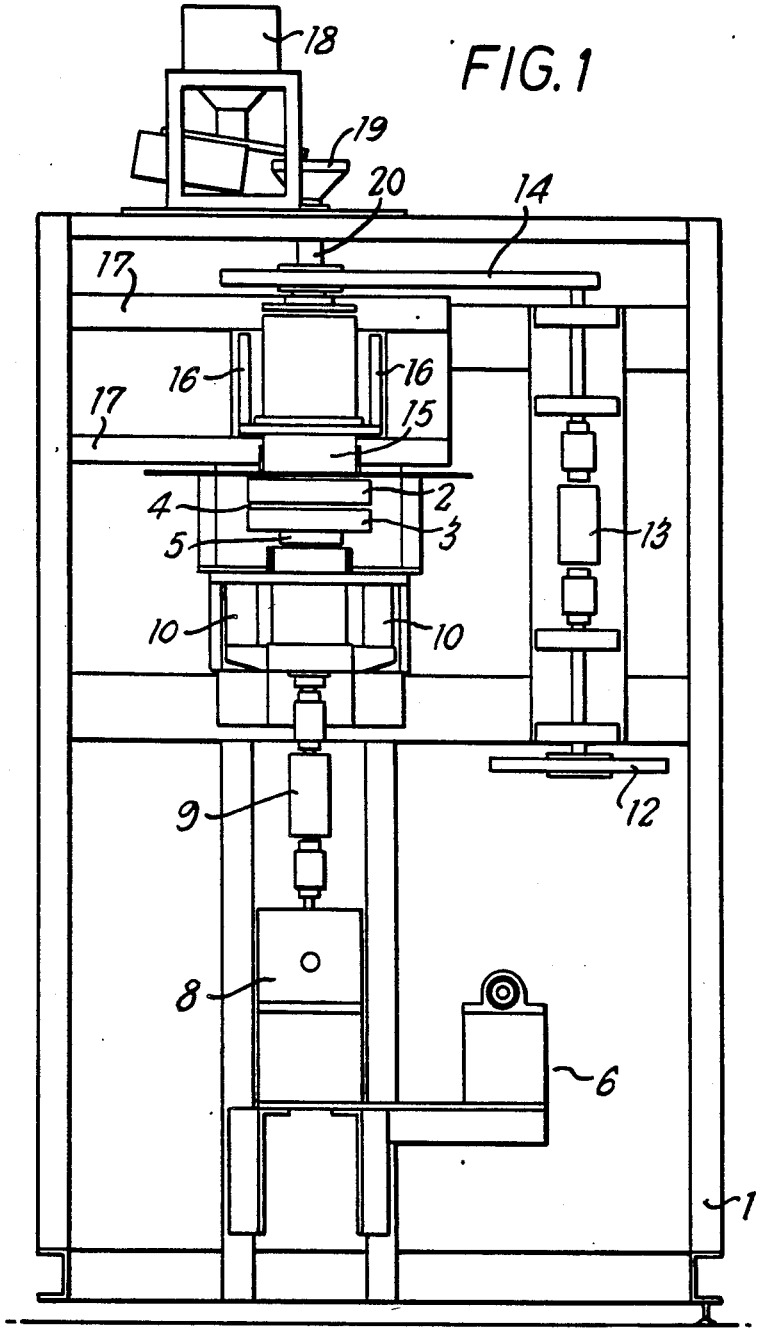
FIG. 1 is a front view of a disc mill constructed in accordance with the invention.
Figure 2:
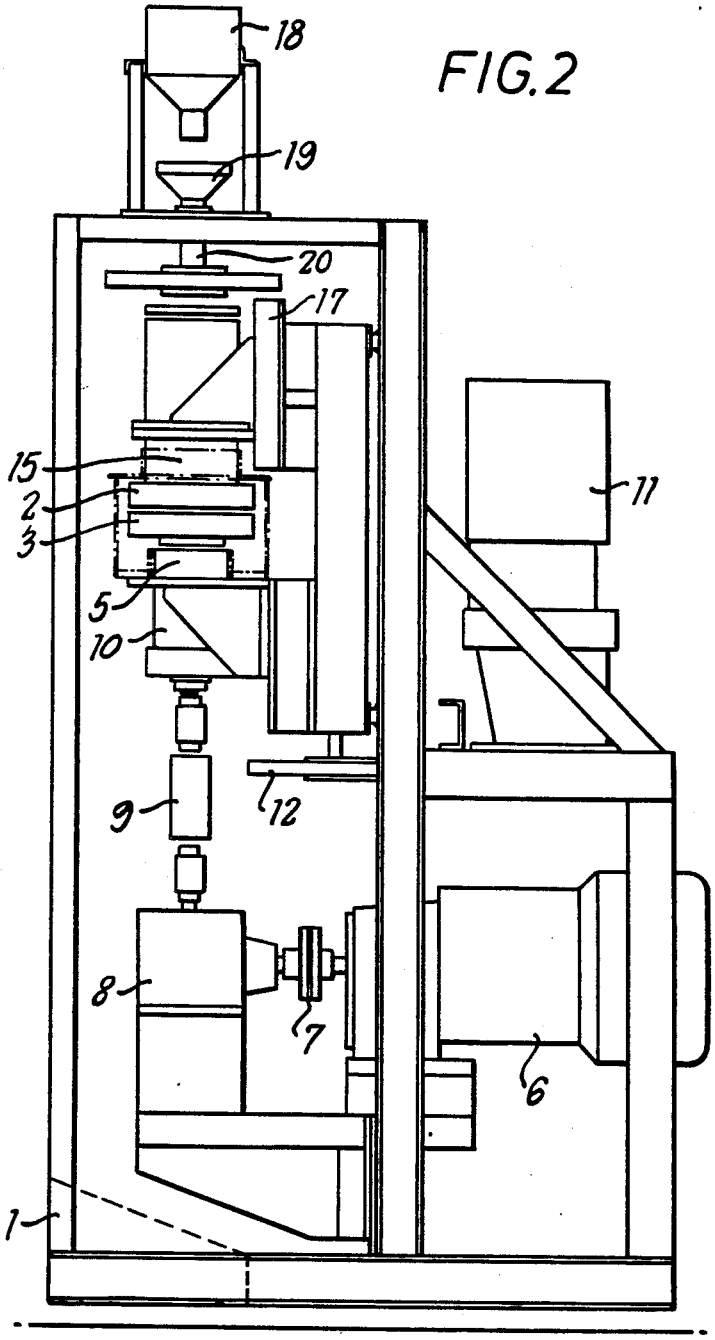
FIG. 2 is a side view of the mill of FIG. 1.

Referring first to FIGS. 1 and 2, a disc mill includes a frame 1 carrying a top disc 2 and a bottom disc 3 with a gap 4 between them. The bottom disc 3 is rotated about its axis of rotation 5 by a variable speed electric motor 6 driving through a coupling 7, gearing 8 and a torque transducer 9. Between the torque transducer 9 and the bottom disc 3 is a load transducer 10 including load cells so as to transmit the load from the lower disc 3 to the torque transducer 9.

The top disc 2 is driven by a variable speed electric motor 11 which drives via a belt 12, a torque transducer 13. Through a further belt 14, the top disc 2 is thus rotated about axis 15.

The axis 15 and thus the top disc 2 may be adjusted on slides 16 to vary the gap 4 between the top disc 2 and bottom disc 3. The axis 15 may also be offset from the axis 5 by the top disc 2 being moved laterally along slides 17.

Figure 3:
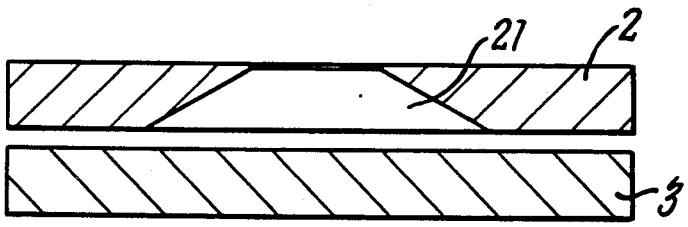
FIG. 3 is a schematic cross-sectional view through the paid of mill discs illustrated in FIGS. 1 and 2 and FIGS. 4 to 8 inclusive are plan views of the profiled surfaces of various constructions of mill disc pairs in accordance with the invention.

Mounted on top of frame 1 is a seed hopper 18 leading to a funnel 19 and an inlet tube 20 for feeding seeds to an axial opening 21 (see FIG. 3) in the top disc 2. As will be seen from FIG. 3, this opening 21 flares outwardly in a downward direction.

In operation the material to be processed, which in one instance may be wheat, is fed from hopper 18 via funnel 19 and inlet 21 to between the discs 2 and 3. The discs 2 and 3 are both rotated in the same or opposite directions and the gap 4 is adjusted to the desired dimension. Also the degree of offset of axes 5 and 15 is adjusted and this controls the throughput of material. Processed wheat is discharged from the periphery of the discs.

Details of the apparatus and running conditions are as follows:

Diameter of discs: 200 mm.
Speed of top/bottom discs: 10 to 1000 rpm.
Minimum gap setting: 0.05 mm.
Maximum gap setting: 6 mm.
Maximum offset: 80 mm.
Maximum torque at 10 rpm: 160 NM.
Maximum torque at 1000 rpm: 8 NM.
Top motor: 1 hp.
Bottom motor: 1.5 hp.
Design wheat throughput: 60 kg/hr.

The maximum throughput for this disc mill is of the order of 100 kg per hour. A larger mill will, of course, have a greater throughput.

Five separate pairs of discs have been provided for alternative use and these are illustrated in FIGS. 4 to 8. All of these discs are made of metal and steel or chilled iron are particularly suitable.

Figure 4:
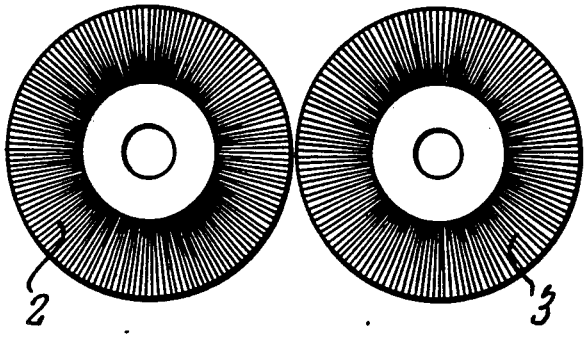

Referring first to the disc pair 2 and 3 of FIG. 4, these were machined with fluting in a radial orientation. The grooves were machined approximately at 30° to 60° and set radially at 2° intervals. This gave 180 grooves per disc.

Figure 5:
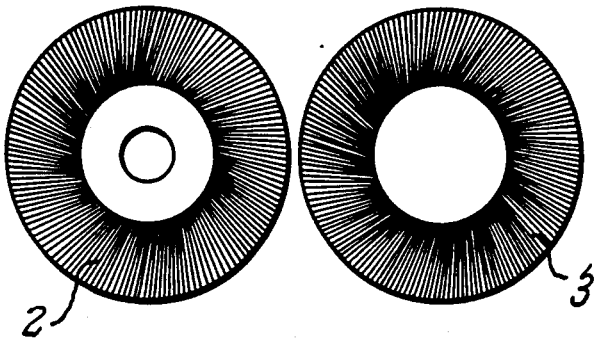

The disc pair 2 and 3 illustrated in FIG. 5 was machined. In this case the fluting was set tangentially to a notional circle with its centre the axis of the disc. The depth of groove was held constant as with the disc pair of FIG. 4, but the gap between the discs tapered by $2\frac{1}{2}°$. The narrowest dimension was at the periphery and the top disc had the taper machined into the profile.

Figure 6:
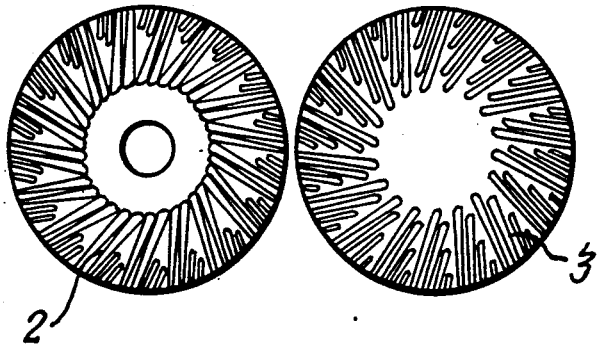

The disc pair 2 and 3 of FIG. 6 were machined with traditional millstone type grooves. These grooves were set tangentially as with the discs of FIG. 5. In the FIG. 6 embodiment, the top and bottom discs were both tapered so that the discs were nearer together at their periphery.

Figure 7:
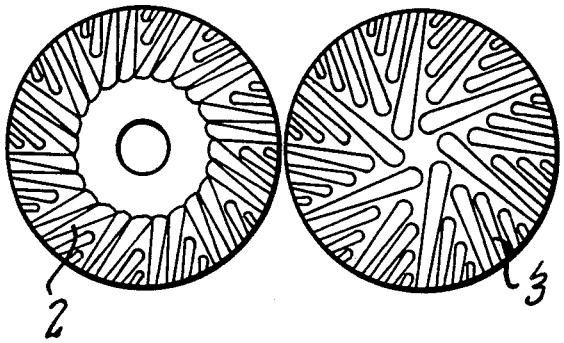

The disc pair 2 and 3 illustrated in FIG. 7 was somewhat similar to those of FIG. 6 except that the grooves were fewer and larger. Also, the taper on the grooves was increased to enlarge the inner feed zone and consequently increase mill capacity. As will be seen from FIG. 7, the main feeder grooves in the bottom disc 3 were machined into the centre of the discs to aid mill capacity.

Figure 8:
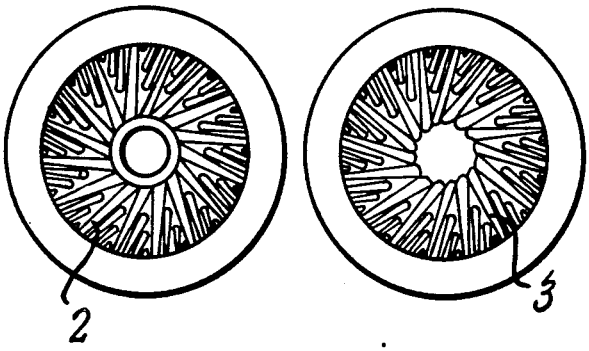

The disc pair 2 and 3 of FIG. 8 were made similar to those of FIG. 6 but with the outer marginal portions of the grooves missing so as to make a nominal diameter of 150 mm.

All of the above pairs of discs find useful application in the apparatus.

Other discs using various profiled surface configurations may be used as appropriate for the material fed to the mill.

We claim:

1. A method of milling seeds or seed derivatives which includes feeding the material by gravity through an axial central opening in a top disc so that the material flows from a point above said top disc and enters the area between the top disc and a bottom disc, said discs having their mutually opposed surfaces profiled and said discs being adjustable to vary the gap between said mutually opposed profiled surfaces, said discs also having respectively associated axes of rotation which are generally vertical and parallel to one another and which may be adjusted to vary their spacing from one another; independently driving both of said discs about their respective axes of rotation at different rotational speeds so that relative movement of the profiled surfaces occurs; and then adjusting the distance between the profiled surfaces and the spacing of the axes of the discs to effect optimum milling and throughput of the material which is discharged at the peripheries of the discs.

2. A method of milling seeds or seed derivatives as defined in claim 1, including the step of adjusting the speed at which at least one of said discs is driven.

3. A disc mill for milling seeds or seed derivatives, said mill comprising a top disc, a bottom disc below said top disc, said top disc and said bottom disc having opposed profiled surfaces to effect milling and also having respectively associated axes of rotation which are substantially vertical and parallel to one another, said top disc having a central axial opening through which said seeds or seed derivatives pass from a supply located above said top disc to the space between said two discs; driving means for independently driving both said top disc and said bottom disc in rotation about their said axes of rotation to cause relative movement of said opposed profiled surfaces; and means for adjusting the distance between said opposed profiled surfaces while said two discs are independently driven by said driving means and for adjusting the spacing between the axes of rotation of said discs while said two discs are independently driven by said driving means to effect optimum milling and throughput of said seed or seed derivatives.

4. A disc mill as defined in claim 3 including a means for adjusting the speed at which at least one of said two discs is driven by said driving means.

5. A disc mill as defined in claim 3 and further including a frame for supporting both of said discs, said means for adjusting said spacing between the axes of rotation of the discs and said means for adjusting the spacing between said opposed profiled surfaces being a means supporting a first one of said discs for rotation about an axis fixed relative to said frame, and a means supporting the other one of said discs for both horizontally adjustable movement relative to said frame and for vertically adjustable movement relative to said frame.

* * * * *